US005367119A

United States Patent [19]

Matsuda et al.

[11] Patent Number: 5,367,119

[45] Date of Patent: Nov. 22, 1994

[54] LOCAL CONTROL FUNCTION APPARATUS HAVING A SINGLE SWITCH

[75] Inventors: Toshinori Matsuda, Shizuoka; Yoshito Nishitani, Hamamatsu, both of Japan

[73] Assignee: Kabushiki Kaisha Kawai Gakki Seisakusho, Hamamatsu, Japan

[21] Appl. No.: 14,976

[22] Filed: Feb. 8, 1993

[30] Foreign Application Priority Data

Mar. 27, 1992 [JP] Japan ..... 4-100287

[51] Int. Cl.[5] ..... G10H 1/06; G10H 1/18; G10H 1/40; G10H 1/46

[52] U.S. Cl. ..... 84/617; 84/622; 84/633; 84/635

[58] Field of Search ..... 84/601-620, 84/622-638, 645, 647-669, DIG. 12

[56] References Cited

U.S. PATENT DOCUMENTS

| | | | |
|---|---|---|---|
| Re. 33,607 | 6/1991 | Yuzawa et al. | 84/609 |
| 4,512,230 | 4/1985 | Ezawa et al. | 84/626 |
| 4,700,604 | 10/1987 | Morikawa et al. | 84/645 X |
| 4,922,794 | 5/1990 | Shibukawa | 84/601 |

*Primary Examiner*—Stanley J. Witkowski

*Attorney, Agent, or Firm*—Joseph C. Mason, Jr.; Ronald E. Smith

[57] ABSTRACT

An electronic musical instrument, which, in consonance with the state of a local control function, is designed to play music independently or in conjunction with an external device, includes a detector for detecting a depression of a predetermined operation terminal immediately after power switch-on. It further includes an initial setup device for setting the initial state of the local control function in accordance with the data acquired by the detector.

8 Claims, 6 Drawing Sheets

LOCAL CONTROL FUNCTION APPARATUS HAVING A SINGLE SWITCH

BACKGROUND OF THE INVENTION

1. Field of the Invention

The present invention relates to an electronic musical instrument, and more particularly to a technique for facilitating the initialization and implementation of a local control function for an electronic musical instrument.

Various electronic musical instruments, such as electronic organs and electronic pianos, have been developed and are now in practical use. These electronic musical instruments generally require multiple operation terminals to select and enable their various functions.

Because the space available for mounting operation terminals is limited, and since manufacturing costs can be reduced by providing fewer controls, electronic musical instruments (in particular, home-use pianos, simply structured keyboards, and student organs) are so designed that manipulation of a number of operation terminals is normally required to select and enable a specific play function.

As using multiple operation terminals to perform a specific operation to set an initial value following power switch-on and initialization, and to thus place an electronic musical instrument into a desired play mode, is both complicated and troublesome, an improved operational procedure is desirable.

2. Description of the Related Art

In a conventional electronic musical instrument, the initial state of the local control function, for example, has to be set after power switch-on. The local control function determines whether an electronic musical instrument will function independently or in conjunction with an external device.

When the local control function of a conventional electronic musical instrument is in the ON state, the electronic musical instrument independently produces musical tones in consonance with play data that are generated at its keyboard.

When the local control function is in the OFF state, however, the electronic musical instrument produces musical tones in consonance with externally supplied play data (for example, externally supplied MIDI data), or outputs, to an external device, play data (MIDI data) that are generated at its keyboard.

As it is difficult, however, to provide a dedicated operation terminal for the activation or deactivation of the local control function, multiple operation terminals are utilized. To set the operational mode of the local control function, multiple operation terminals (buttons) must either be depressed simultaneously or must be repeatedly depressed in a prescribed sequential order. Then, to alter the ON/OFF state of the local control function the same procedure must be repeated.

Because the local control function is normally set to its ON state when power is switched on, if an electronic musical instrument is to be used with its local control function in the OFF state, the above described state switching must be performed. As the procedure is both complicated and laborious to perform, entry errors are easy to make.

SUMMARY OF THE INVENTION

To overcome the described shortcomings, it is an object of the present invention to provide a highly efficient electronic musical instrument wherein a simple operation determines the ON/OFF state of the local control function.

To achieve the above object, an electronic musical instrument according to the present invention, which, in consonance with the state of a local control function, is designed to play music independently or in conjunction with an external device, comprises: detecting means for detecting a depression of a predetermined operation terminal immediately after power switch-on; and initial setup means for setting the initial state of the local control function in accordance with the data acquired by the detecting means.

As one aspect of the present invention, a designated switch, or a specified operation terminal, such as a keyboard key, is used for activation/deactivation of a local control function. After power switch-on, that switch or operation terminal is examined to determine whether it has been depressed. According to the obtained result, the local control function is initially set to either the ON or the OFF state.

The conventional, complicated operation, which requires the use of multiple operation terminals to set the operational mode of the local control function, and which must be repeated each time the ON/OFF state of the function is altered, is eliminated. As initialization and implementation of the local control function can be performed by a single operation, e.g., the depression of a specific operation terminal, a highly efficient electronic musical instrument can be provided.

DETAILED DESCRIPTION OF THE PREFERRED EMBODIMENT

The preferred embodiment of the present invention will now be described while referring to the accompanying drawings.

Figure 1:
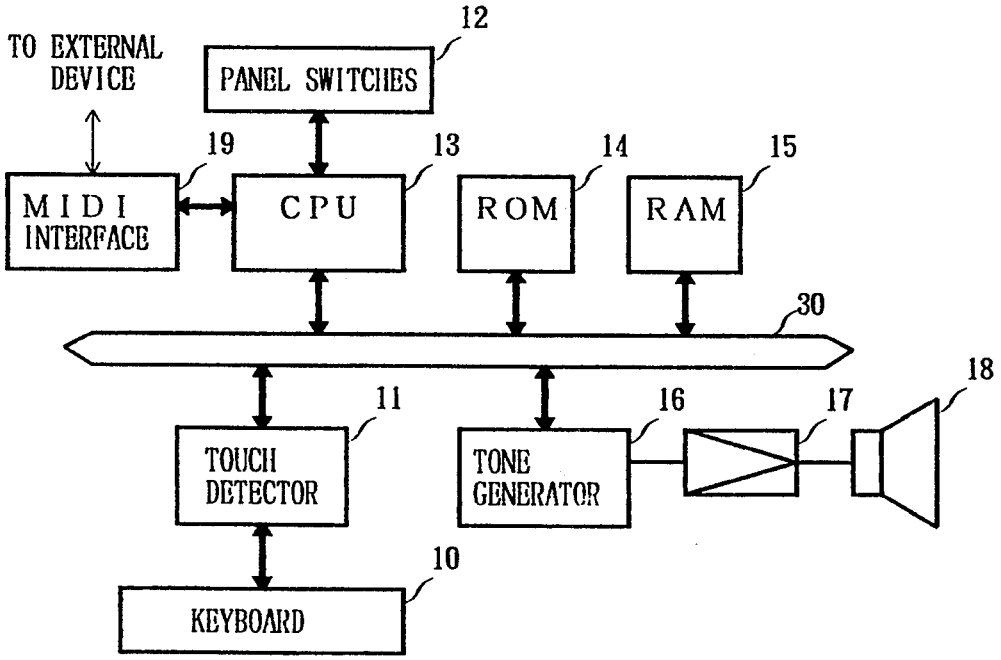
FIG. 1 is a schematic diagram illustrating the general structure of one embodiment of an electronic musical instrument according to the present invention.

FIG. 1 is a schematic block diagram showing the general structure of an electronic musical instrument according to the present invention.

A keyboard 10 is used to select a musical tone that is to be generated. The keyboard 10 includes for each key a key switch (not shown) that closes or opens as the key is depressed or released, and a key scan circuit (also not shown) that detects the closed/open states of the key switches.

From the keyboard 10, a signal that indicates a key switch ON/OFF state that has been detected by the key scan circuit is sent to a touch detector 11.

Upon reception of the switch ON/OFF state data signal, the touch detector 11 generates touch data that shows the strength (velocity) of key depression, and also outputs ON/OFF information or information that identifies a depressed/released key, i.e., key number data. The ON/OFF data, the key number data, and the touch data are sent to a central processing unit (CPU) 13 via a system bus 30.

Panel switches 12, provided on an operation panel (not shown), are used to control the various operations of the electronic musical instrument.

The panel switches 12 include timbre select switches, a rhythm select switch, a volume switch, etc. In this embodiment, one of the timbre select switches, for example, a switch for selecting "piano," is used to enable and disable a local control function.

Figure 2:
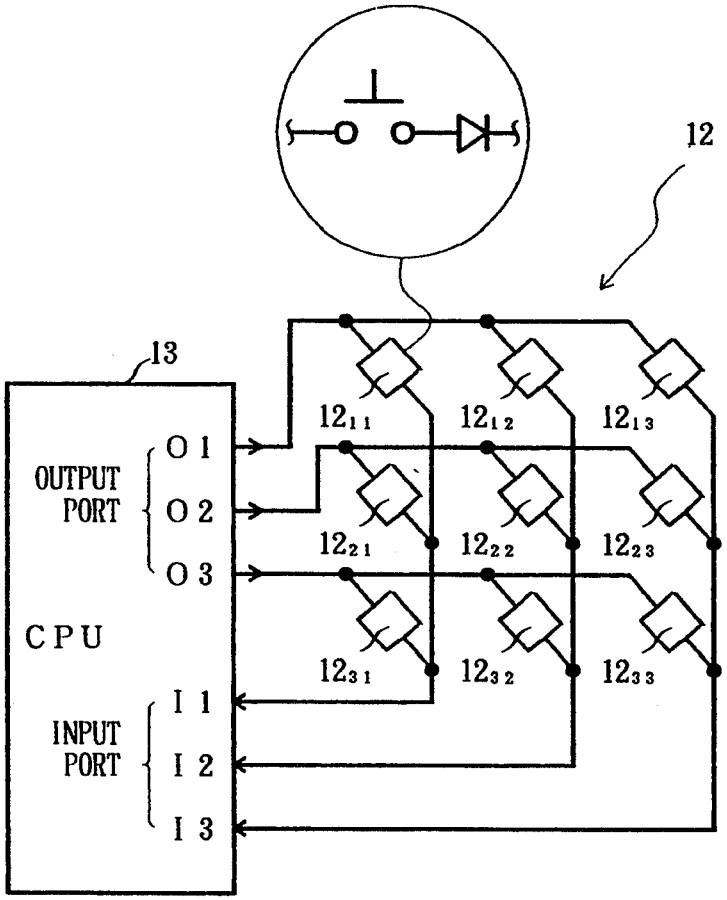
FIG. 2 is a diagram illustrating an example of a panel switch circuit in the embodiment of the present invention.

An example of a circuit for the panel switches 12 is shown in FIG. 2, where nine switches are arranged as in a matrix. Switching elements $12_{11}$ to $12_{33}$, each consisting of a switching contact and a diode, as illustrated in the enlarged inset, are located at the intersections of the matrix.

Scan signals, which carry the ON/OFF states of the individual switching elements, are sequentially emitted by output ports O1, O2, and O3 of the CPU 13, and sequentially received by input ports I1, I2, and I3 of the CPU 13.

If the switching element $12_{12}$ is ON when a scan signal is output via the output port O1, an H-level signal is sent to the input port I2 and L-level signals are sent to the input ports I1 and I3. Accordingly, the data input to the CPU 13 indicates that the switching element $12_{12}$ is ON. The described process is performed when other switching elements are ON.

Referring to FIG. 1 again, the CPU 13 employs a control program that is stored in a read only memory (hereafter referred to as "ROM") 14 to control the individual sections of the electronic musical instrument.

The ROM 14 stores not only the control program but also various datum constants to be used by the CPU 13. The ROM 14 is accessed by the CPU 13 via the system bus 30.

In a random access memory (hereafter referred to as "RAM") 15, are defined a work area for the CPU 13, and various registers, counters, flags, etc for controlling the electronic musical instrument. The RAM 15 is accessed by the CPU 13 via the system bus 30.

A tone generator 16, in consonance with information supplied by the CPU 13, reads tone wave data and envelope data from a tone wave memory (not shown), adds an envelope to the read-out tone wave data, and outputs the resultant data as a tone signal. This tone signal is sent by the tone generator 16 to an amplifier 17.

The amplifier 17 amplifies the received tone signal by a predetermined gain, and sends the resultant signal to a loudspeaker 18. The loudspeaker 18 is a well known transducer that converts an electric signal into an acoustic signal.

A MIDI interface circuit 19 controls reception and transmittance of MIDI signals passed between the CPU 13 and an external device.

The touch detector 11, the CPU 13, the ROM 14, the RAM 15, and the tone generator 16 are mutually connected by the system bus 30.

Figure 4:
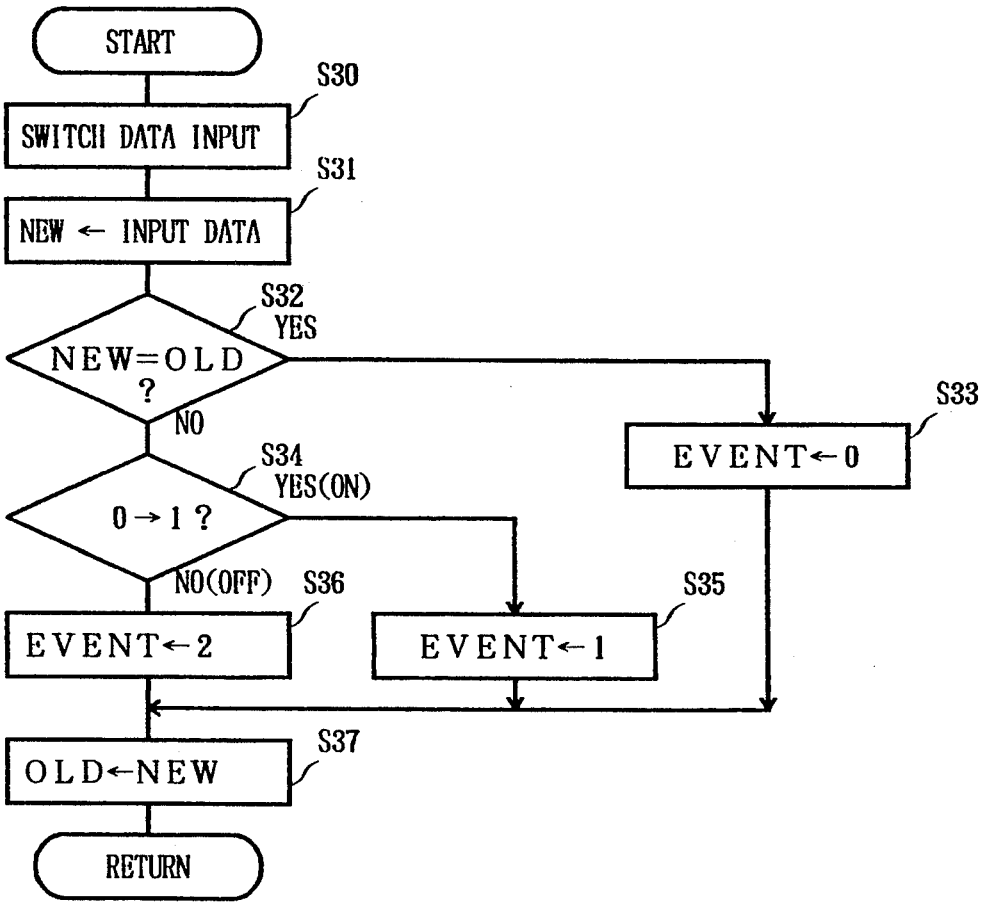
FIG. 4 is a flowchart of the switch scan process in FIG. 2.
Figure 5:
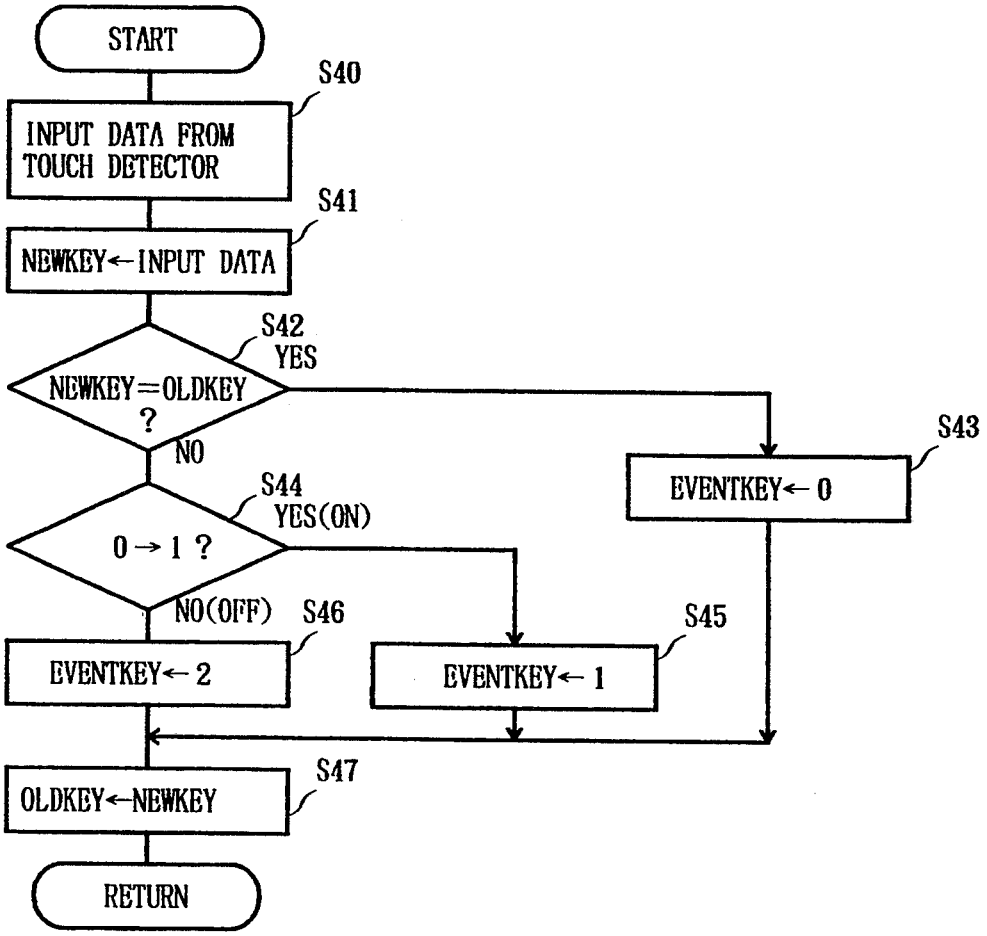
FIG. 5 is a flowchart of the keyboard scan process in FIG. 2.

With the above described arrangement, the operation of the embodiment of the present application will now be explained while referring to the flowcharts shown in FIGS. 3 to 5.

Figure 3:
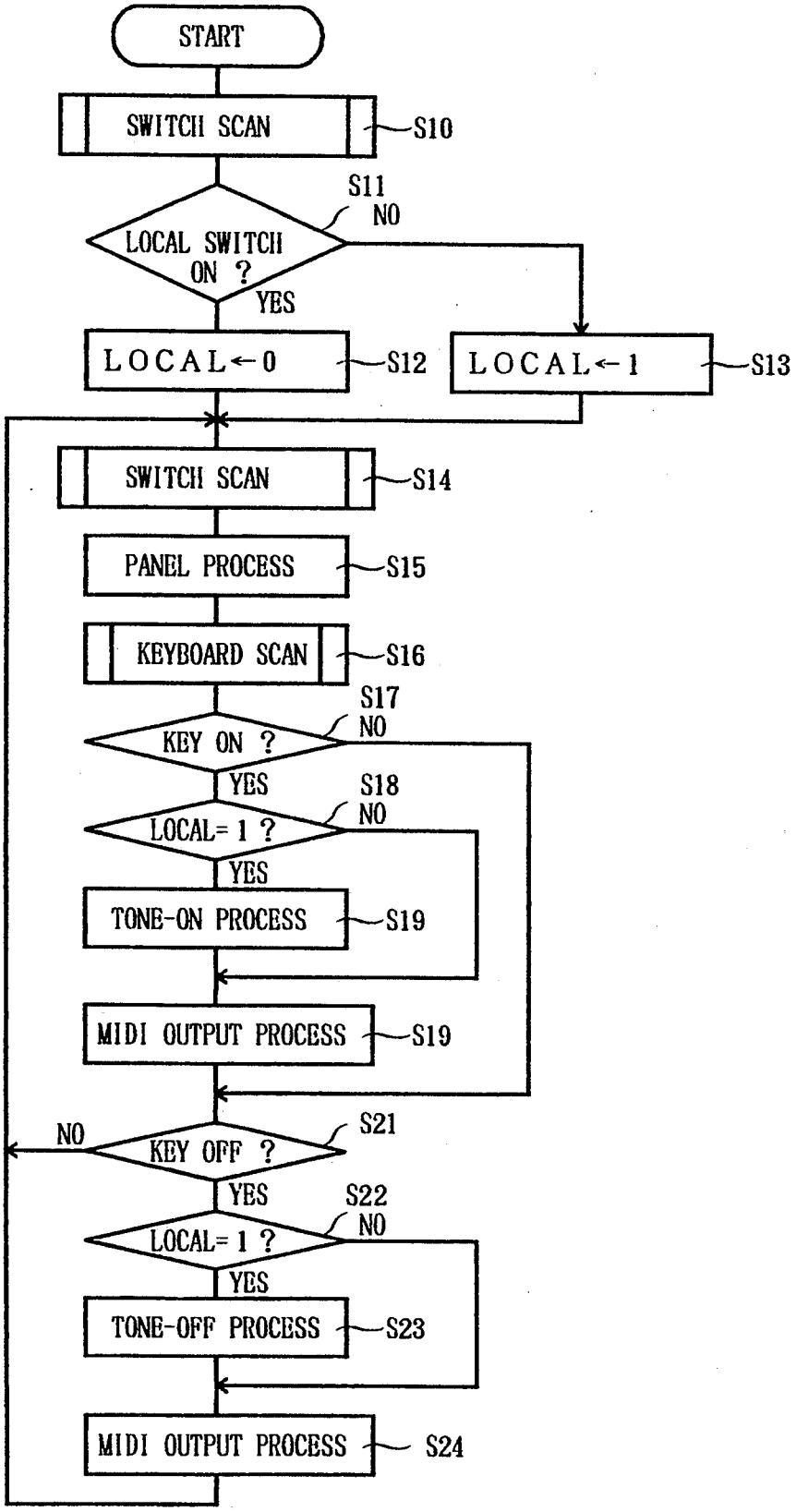
FIG. 3 is a flowchart of the main routine of the embodiment of the present invention.

When an electronic musical instrument is switched on, initialization of the main routine shown in FIG. 3 is performed and processing is begun. The initialization process (not shown) is performed first. During this process the initial internal state of the tone generator 16 is set so as to prevent the production of unwanted sounds that may occur when the power is switched on, the work area in the RAM 15 is cleared, and the registers, the counters, the flags, etc. (that are defined in the RAM 15) are set to their initial states.

Following this, a switch scan process is performed (step S10). The details of the switch scan process will now be described while referring to the flowchart in FIG. 4.

For this process are employed a NEW buffer, an OLD buffer and an EVENT buffer, each of which is provided to store data related to the panel switches.

The data most recently received from the panel switches are stored in the NEW buffer, and the data that were previously received from the panel switches are stored in the OLD buffer.

The EVENT buffer is used to store data that indicate whether or not switch events have occurred, and data that indicate the event types. Table 1 shows the organization of the EVENT buffer as it relates to the panel switches.

TABLE 1

| setup value | event information |
|---|---|
| 0 | no change |
| 1 | set to ON state |
| 2 | set to OFF state |

In the switch scan process, switch data input is performed first (step S30). In other words, the CPU 13 reads data that is received at the input port, and stores that data in the NEW buffer (step S31).

Then, the content of the NEW buffer is compared with that of the OLD buffer (step S32). When they are found to be the same, the setup value in the EVENT buffer is set to "0" (step S33). That is, since a value of "0" is used to indicate that the currently read data is equal to the previously read data and that no switch event change has occurred, the setup value in the EVENT buffer is set to "0".

When the content of the NEW buffer does not equal that of the OLD buffer, a check is performed to determine whether a change from "0" to "1" has been made (step S34). In other words, a check is performed to determine whether the value stored in the OLD buffer is "0" and the value stored in the NEW buffer is "1".

When a change from "0" to "1" is found to have been made, the setup value in the EVENT buffer is set to "1" (step S35). That is, the occurrence of an ON event is denoted by the setup value entry in the EVENT buffer.

If, at step S34, a change from "0" to "1" has not been made, the setup value in the EVENT buffer is set to "2" (step S36). That is, the occurrence of an OFF event is denoted by the setup value entry in the EVENT buffer.

Subsequently, the content of the NEW buffer is shifted to the OLD buffer (step S37), and program control returns from the switch scan process routine to the main routine.

Although the switch scan process for only one panel switch has been described above, the same process will be performed for all the switches that are provided on the electronic musical instrument.

In the main routine, a check is then performed to determine whether or not a local switch has been set to the ON state (step S11). The local switch enables or disables the local control function, and in this embodiment, a check is performed to determine whether or not one of the timbre select switches, "piano," has been depressed, as described above. This determination is made by referring to the event map that is prepared during the switch scan process.

When the local switch is found to be ON, the value held by a flag LOCAL is set to "0" (step S12). The electronic musical instrument will therefore function in conjunction with an external device.

When the local switch is not ON, the value held by the flag LOCAL is set to "1" (step S13). The electronic musical instrument will therefore function independently.

Then, a switch scan process is performed (step S14). This process is the same as that performed at step S10.

Subsequently, a panel process is performed for the panel switches that were found to be in the ON state during the switch scan process (step S15). For example, in consonance with the manipulation of a timbre select switch, a rhythm select switch, or a volume switch, a timbre change process, a rhythm change process, or a volume control process is performed.

Following this, a keyboard scan process is performed (step S16). The details of the keyboard scan process will now be described while referring to the flowchart in FIG. 5.

Figure 6:
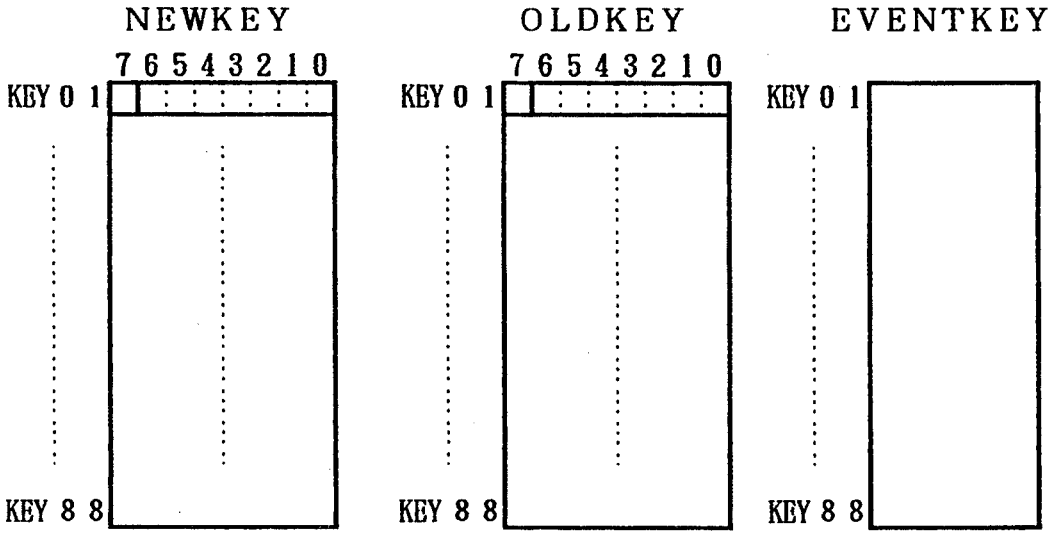
FIG. 6 is a diagram for explaining the organization of buffers to be used during the keyboard scan process.

For this process are employed a NEWKEY buffer, an OLDKEY buffer and an EVENTKEY buffer, each of which includes areas corresponding to keys 01 to 88, as shown in FIG. 6.

The data most recently received from the keyboard 10 are stored in the NEWKEY buffer, and the data that were previously received from the keyboard 10 are stored in the OLDKEY buffer. These buffers include a one-byte area for each key. In each byte, data indicating the key ON/OFF state ("0" is key-OFF and "1" is key-ON) is stored in the MSB (bit 7), while touch data is stored in the remaining seven bits (bits 0 to 6).

The EVENTKEY buffer is used to store data that indicate whether or not key events have occurred, and data that indicate the event types. The organization of the EVENTKEY buffer as it relates to keys on the keyboard 10 is shown in Table 1 above.

In the keyboard scan process, keyboard data input is performed first (step S40). In other words, the CPU 13 receives key number data, key ON/OFF data, and touch data from the touch detector 11, and stores those data in the NEWKEY buffer (step S41).

Then, the content of the NEWKEY buffer is compared with that of the OLDKEY buffer (step S42). When they are found to be the same, the setup value in the EVENTKEY buffer is set to "0" (step S43). That is, since a value of "0" is used to indicate that the currently read data is equal to the previously read data and that no switch event change has occurred, the setup value in the EVENTKEY buffer is set to "0".

When the content of the NEWKEY buffer does not equal that of the OLDKEY buffer, a check is performed to determine whether a change from "0" to "1" has been made (step S44). In other words, a check is performed to determine whether the value stored in the OLDKEY buffer is "0" and the value stored in the NEWKEY buffer is "1".

When a change from "0" to "1" is found to have been made, the setup value in the EVENTKEY buffer is set to "1" (step S45). That is, the occurrence of an ON event is denoted by the setup value entry in the EVENTKEY buffer.

If, at step S44, a change from "0" to "1" has not been made, the setup value in the EVENTKEY buffer is set to "2" (step S46). That is, the occurrence of an OFF event is denoted by the setup value entry in the EVENTKEY buffer.

Subsequently, the content of the NEWKEY buffer is shifted to the OLDKEY buffer (step S47), and program control returns from the keyboard scan process routine to the main routine.

Although the keyboard scan process for only one key has been described above, the same process will be performed for all the keys, 01 to 88, that are provided on the electronic musical instrument.

In the main routine, a check is performed to determine whether or not a key is in the ON state (step S17). In other words, whether or not a key-ON event has occurred is determined by examining the EVENTKEY buffer that is prepared during the keyboard scan process.

When a key-ON event is found to have occurred, a check is performed to determine whether or not the value held by the flag LOCAL is "1" (step S18). This determination is made by examining the flag LOCAL that is defined in the RAM 15 following power switch-on.

When the value held by the flag LOCAL is found to be "1", it is assumed that the electronic musical instrument is to function independently, and a tone-ON process is performed (step S19). Since this process is well known, it will not be explained here.

Then, a MIDI output process is performed (step S20). More specifically, the key-ON event information (play data used in the tone-ON process) is sent as MIDI information via the MIDI interface circuit 19 to an external device. Tone generation, or recording, by the external device is thereafter performed.

If, at step S18, the value held by the flag LOCAL is found to be "0", it is assumed that the electronic musical instrument is to function in conjunction with an external device. The tone-ON process (step S19) is omitted and only the MIDI output process (step S20) is performed. That is, the electronic musical instrument does not generate musical tones; musical tones are generated, or recording is performed, by an external device.

If, at step S17, a key-ON event has not occurred, the tone-ON process (step S19) and the MIDI output process (step S20) are omitted.

A check is then performed to determine whether or not a key is in the OFF state (step S21). In other words, whether or not a key-OFF event has occurred is determined by examining the EVENTKEY buffer that is prepared during the keyboard scan process.

When a key-OFF event is found to have occurred, a check is performed to determine whether or not the value held by the flag LOCAL is "1" (step S22). This determination is made by examining the flag LOCAL that is defined in the RAM 15 following power switch-on.

When the value held by the flag LOCAL is found to be "1", it is assumed that the electronic musical instrument is to function independently, and a tone-OFF process is performed (step S23). Since this process is well known, it will not be explained here.

Then, a MIDI output process is performed (step S24). More specifically, the key-OFF event information (play data used in the tone-OFF process) is sent as MIDI information via the MIDI interface circuit 19 to an external device. Accordingly, tone generation halt, or recording, by the external device is performed.

If, at step S22, the value held by the flag LOCAL is found to be "0", it is assumed that the electronic musical instrument is to function in conjunction with an external device. The tone-OFF process (step S23) is omitted and only the MIDI output process (step S24) is performed. That is, the generation of musical tones is not halted by the electronic musical instrument; the generation of musical tones is halted, or recording is performed, by an external device.

Program control then returns to step S14 and the described process is repeated. Tone generation in consonance with key depression is performed with a timbre, a volume and a tempo that are selected at the operation panel; alternatively tone generation halt in consonance with key release is performed.

If, at step S21, a key-OFF event has not occurred, the tone-OFF process (step S23) and the MIDI output process (step S24) are omitted.

As described above, according to the present invention, one of the timbre select switches is also used for activation/deactivation of a local control function. After power switch-on, that timbre select switch is examined to determine whether it has been depressed. Depending on the obtained result, the local control function is initially set to either the ON or the OFF state.

The conventional, complicated operation, which requires the use of multiple operation terminals to set the operational mode of the local control function, and which must be repeated each time the ON/OFF state of the function is altered, is eliminated. As initialization and implementation of the local control function can be performed by a single operation, e.g., the depression of one of the timbre select switches, a highly efficient electronic musical instrument can be provided.

Although in the above embodiment one of the timbre select switches is used to enable and disable the local control function, other panel switches may be used for this purpose. Also, a specified key on a keyboard may be used to enable and disable the local control functions, and the same effect as in the above embodiment can be obtained.

As described above in detail, the present invention can provide a highly efficient electronic musical instrument that employs a simple, uncomplicated operation to enable and disable the local control function.

What is claimed is:

1. An electronic musical instrument, which, depending upon the state of a local control function, plays music independently or in conjunction with an external device that is in electrical communication with said electronic musical instrument, said electronic musical instrument having a power switch having an "on" and an "off" state, comprising:

a plurality of operational terminals, each operational terminal of said plurality of operational terminals having an "on" state and an "off" state;

a predetermined operational terminal of said plurality of operational terminals being designated as a local control function switch;

detecting means for detecting depression of said predetermined operational terminal immediately after said power switch is placed in its "on" position;

said detecting means including scanning means for scanning said plurality of operational terminals;

an event map means for providing data to said detecting means concerning a prior setting of said predetermined operational terminal;

initial setup means for setting an initial state of said local control function in accordance with data acquired by said detecting means;

the local control function of said electronic musical instrument being placed into its previous setting immediately after power switch-on if the event map means indicates that there has been no change in the position of the predetermined operational terminal from a previous position thereof; and said local control function being changed from its previous position immediately after power switch-on if the event map indicates that a change has occurred in the position of the predetermined operational terminal relative to a previous position thereof.

2. The electronic musical instrument of claim 1, wherein said predetermined operational terminal is a predetermined panel switch and wherein said scanning means includes a panel switch scanning means.

3. The electronic musical instrument of claim 2, wherein said predetermined panel switch is a rhythm select switch.

4. The electronic musical instrument of claim 2, wherein said predetermined panel switch is a timbre select switch.

5. The electronic musical instrument of claim 2, wherein said predetermined panel switch is a volume switch.

6. The electronic musical instrument of claim 1, wherein said predetermined operational terminal is a predetermined key on a keyboard that forms a part of said electronic musical instrument, and wherein said scanning means includes a keyboard scanning means.

7. The electronic musical instrument of claim 1, further comprising a NEW buffer means and an OLD buffer means for storing data concerning the position of said predetermined operational terminal, and wherein said event map is prepared with information derived from a comparison of data in said NEW buffer means with data in said OLD buffer means, said information being derived from said respective buffer means by said detecting means.

8. The electronic musical instrument of claim 1, wherein said initial setup means includes means for setting an internal state of a tone generator to an initial state, means for clearing a work area in a RAM, and means for setting registers, counters, and flags in said RAM to their respective initial states.

* * * * *